US009988863B2

(12) United States Patent
Gaskin et al.

(10) Patent No.: US 9,988,863 B2
(45) Date of Patent: Jun. 5, 2018

(54) APPARATUS AND METHOD FOR CONNECTING COMPONENTS

(71) Applicant: Titan Torque Services Limited, Aberdeen (GB)

(72) Inventors: Keith Gaskin, Aberdeen (GB); Bruce Jepp, Aberdeen (GB)

(73) Assignee: Titan Torque Services Limited, Aberdeen, Aberdeenshire (GB)

( * ) Notice: Subject to any disclaimer, the term of this patent is extended or adjusted under 35 U.S.C. 154(b) by 327 days.

(21) Appl. No.: 14/650,756

(22) PCT Filed: Dec. 13, 2013

(86) PCT No.: PCT/GB2013/053294
§ 371 (c)(1),
(2) Date: Jun. 9, 2015

(87) PCT Pub. No.: WO2014/091246
PCT Pub. Date: Jun. 19, 2014

(65) Prior Publication Data

US 2015/0315858 A1 Nov. 5, 2015

(30) Foreign Application Priority Data

Dec. 13, 2012 (GB) ..... 1222502.5

(51) Int. Cl.
*E21B 19/16* (2006.01)
*E21B 19/15* (2006.01)

(52) U.S. Cl.
CPC ..... *E21B 19/164* (2013.01); *E21B 19/15* (2013.01); *E21B 19/163* (2013.01); *E21B 19/165* (2013.01)

(58) Field of Classification Search
CPC ..... E21B 19/163; E21B 19/164; E21B 19/15; E21B 19/165; B25B 13/5016
See application file for complete search history.

(56) References Cited

U.S. PATENT DOCUMENTS 3,025,733 A 3/1962 Soodnizin
3,196,717 A 7/1965 Sheppard
(Continued)

FOREIGN PATENT DOCUMENTS

WO WO 1992/018744 A1 10/1992
WO WO 2003/069113 A2 8/2003
(Continued)

OTHER PUBLICATIONS

International Search Report dated Feb. 26, 2015 for International Patent Application No. PCT/GB2013/053294.

*Primary Examiner* — Nicole Coy
(74) *Attorney, Agent, or Firm* — Pepper Hamilton LLP

(57) ABSTRACT

An apparatus (1) for connecting elongate components (6, 8), the apparatus (1) comprising a pair of tong units (2, 4) for receiving and gripping respective elongate components (6, 8) and connecting the elongate components (6, 8) end-to-end, wherein at least one of the tong units (2, 4) is adapted to rotate the gripped elongate component (6, 8); wherein each of the first and second tong units (2, 4) defines a central opening (10, 12) where the respective elongate component (6, 8) is gripped, the central opening (10, 12) having a substantially horizontal central axis (14) and a side access (16, 18) opening for inserting the elongate component (6, 8) into the central opening (10, 12) radially relative to the central axis (14); wherein the tong units (2, 4) are spaced apart substantially horizontally so that the elongate components (6, 8) to be connected are inserted and gripped in the tong units (2, 4) in a substantially horizontal orientation. An arrangement for controlling gripping force exerted on the elongate components (6, 8) by the tong units (2, 4) is also provided.

35 Claims, 7 Drawing Sheets

(56) References Cited

U.S. PATENT DOCUMENTS 4,084,453 A 4/1978 Eckel
4,250,773 A 2/1981 Haynes et al.
4,445,402 A * 5/1984 Farr ..... E21B 19/164 173/164
4,487,092 A 12/1984 Neves
4,497,224 A 2/1985 Jurgens
4,827,808 A 5/1989 Haynes et al.
5,159,860 A 11/1992 Pietras
5,520,072 A * 5/1996 Perry ..... E21B 19/163 81/57.16
6,598,501 B1 7/2003 Schulze-Beckinghausen et al.
6,684,737 B1 2/2004 Schulze-Beckinghausen et al.
6,745,646 B1 6/2004 Pietras et al.
6,752,043 B2 * 6/2004 Carlson ..... E21B 19/18 81/57.15
6,965,230 B2 * 11/2005 Rogers ..... E21B 19/165 324/207.16
7,028,585 B2 4/2006 Pietras et al.
7,281,451 B2 10/2007 Schulze Beckinghausen
7,506,564 B2 3/2009 Schulze-Beckinghausen
7,690,281 B2 * 4/2010 Hobgood ..... E21B 19/165 81/57.16
7,861,618 B2 1/2011 Pietras et al.
2002/0157823 A1 10/2002 Pietras et al.
2003/0056623 A1 3/2003 Carlson
2003/0132030 A1 * 7/2003 Tompkins ..... E21B 19/20 175/52
2003/0177870 A1 9/2003 Neves et al.
2004/0174163 A1 * 9/2004 Rogers ..... E21B 19/165 324/228
2006/0053977 A1 * 3/2006 Hawkins, III ..... E21B 19/161 81/57.34
2006/0174729 A1 8/2006 Slettedal et al.
2006/0196316 A1 9/2006 Slettedal et al.
2006/0213655 A1 * 9/2006 Huddleston ..... E21B 19/24 166/85.5
2009/0277308 A1 11/2009 Light et al.
2010/0117282 A1 * 5/2010 Rozendaal ..... E21B 19/164 269/111
2010/0199812 A1 8/2010 Richardson
2013/0305884 A1 * 11/2013 Dobush ..... E21B 19/168 81/57.33

FOREIGN PATENT DOCUMENTS

WO WO 2004/076806 A1 9/2004
WO WO 2004/079148 A2 9/2004

* cited by examiner

APPARATUS AND METHOD FOR CONNECTING COMPONENTS

CROSS-REFERENCE TO RELATED APPLICATIONS

The present application is a National Stage filing under 35 U.S.C. § 371 of International Patent Application No. PCT/GB2013/053294, filed on Dec. 13, 2013 entitled "Apparatus and Method for Connecting Components", which claims the benefit of and priority to United Kingdom Application No. 1222502.5, filed on Dec. 13, 2012, both of which are incorporated by reference herein in their entireties.

FIELD OF THE INVENTION

The present invention provides an apparatus and a method for connecting various components including elongate members, such as, for example, drillstring, casing or liner tubulars, end-to-end by gripping and applying torque to the components.

BACKGROUND TO THE INVENTION

In wellbore drilling and completion, various components, including tubular elements (also typically referred to in the industry as "tubulars") need to be connected to each other end-to-end or disconnected from each other, typically via corresponding threads at respective ends of the components. For example, in drilling, lengths of drillpipe need to be connected end-to-end in order to connect equipment at rig surface with a bottomhole assembly downhole.

In the past, manual tongs were used to make and break connection between tubulars and other components. This method was slow and inefficient and has been replaced by motorised tong units which can grip the tubulars in end-to-end orientation and apply torque, typically to one of the tubulars, to rotate the tubulars relative to one another in order to screw or unscrew the tubulars. Motorised tong units, however, had their own limitations including, for example, suitability for only relatively small ranges of pipe diameters. This drawback was overcome by providing the tongs with hydraulically actuated gripping jaws which were adjustable to grip pipes from wider ranges of diameters. However, this entailed difficulties in establishing and maintaining an adequate grip on the tubulars during rotation. A number of solutions have been proposed to address this problem.

For example, WO2004/076806 A1 (Maritime Hydraulics) describes a torque tong machine comprising a stationary tong unit for gripping one pipe and a rotating tong unit for gripping and rotating another pipe to connect it to the first pipe. The rotating tong unit has a fixed part and a rotary part mounted on the fixed part for gripping and rotating a pipe. The rotary part has gripping jaws which are movable into engagement with the pipe by respective hydraulic gripping cylinders arranged on the fixed part. Additionally, each gripping jaw includes a hydraulic holding cylinder mounted on the rotary part and the piston of the holding cylinder is operatively connected to the gripping jaw. When the gripping jaws are moved by the gripping cylinders, the pistons in the holding cylinders are moved out causing hydraulic fluid to flow into the holding cylinders. The fluid in the holding cylinders is controlled by a valve arrangement mounted on the rotary part and actuatable by a movable plate arranged on the fixed part and by a hydraulic master cylinder on the fixed part which controls a hydraulic slave cylinder on the rotary part. Once the desired pressure has been set on the holding cylinders, the valves are closed and the plate and the master cylinder are disconnected from the rotary part to enable rotation of the rotary part. Once the rotary unit starts rotating, it is not possible to control the pressure in the holding cylinders because the connection with the master cylinder on the fixed part has been interrupted.

A further disadvantage of the arrangement of WO2004/076806 A1, is that, like in many prior art arrangements, the stationary tong unit and the rotating tong unit are vertically spaced from one another to receive and rotate the tubulars in upright orientations. Thus, the tubulars to be connected, which are normally stored horizontally, need to be brought into upright positions before they can be received in and gripped by the tong units which is relatively cumbersome and can add significantly to the overall costs of connecting the tubulars.

Accordingly, the object of the present invention is to provide an improved tong apparatus and method for connecting tubulars which obviates and/or mitigates the above drawbacks.

SUMMARY OF THE INVENTION

According to a first aspect of the invention there is provided an apparatus for connecting elongate components, the apparatus comprising a pair of tong units for receiving and gripping respective elongate components and connecting the elongate components end-to-end, wherein at least one of the tong units is adapted to rotate the gripped elongate component;

wherein each of the first and second tong units defines a central opening where the respective elongate component is gripped, the central opening having a substantially horizontal central axis and a side access opening for inserting the elongate component into the central opening radially relative to the central axis;

wherein the tong units are spaced apart substantially horizontally so that the elongate components to be connected are inserted and gripped in the tong units in a substantially horizontal orientation.

For the purposes of describing the present invention, the term "horizontally", unless specified otherwise, is used in relation to a surface on which the apparatus of the present invention rests during normal use.

Preferably, the side access openings of the tong units face substantially in the same direction.

In one modification, the side access openings face substantially sideways (preferably in a direction substantially parallel to a surface on which the apparatus of the present invention rests during normal use), so that the elongate components to be connected can be lifted approximately level with the side access openings in a substantially horizontal orientation and then moved on the tong units to enter the side access openings and the respective central openings, and/or moved off the tong units in the same substantially horizontal orientation. The elongate components can be moved on the tong units coupled together and moved off decoupled from each other or moved on not coupled and moved off coupled. Moving the elongate components preferably includes rolling the elongate components. Such an arrangement provides a significant advantage over vertically arranged prior art tong units because it eliminates the need to pivot the elongate components, many of which are normally stored horizontally, into a vertical position. Instead, both elongate components can be raised level with the side access openings in the same horizontal orientation in which they are stored and moved on the tong units. Similarly, the elongate components can be easily extracted from the tong units by moving the elongate components off the tong units without the need to grip the elongate components securely while the elongate components are still gripped by the by the tong units.

In a further modification, the side access openings face substantially upwardly (preferably in a direction substantially perpendicular to a surface on which the apparatus of the present invention rests during normal use), so that the elongate components to be connected can be brought (e.g. lifted) above the tong units in a substantially horizontal orientation and then lowered or dropped into the respective central openings through the side access openings in the same substantially horizontal orientation. Such an arrangement also provides a significant advantage over vertically arranged prior art tong units because it eliminates the need to pivot the elongate components, many of which are normally stored horizontally, into a vertical position. Instead, both elongate components can be raised in the same horizontal orientation in which they are stored and then lowered or simply dropped into the tong units.

Preferably, one of the tong units is a rotational unit configured to receive, grip and rotate a elongate component, whereas the other tong unit is a non-rotational unit configured to receive and grip the other elongate component.

The apparatus preferably comprises a frame having a substantially horizontal part and the tong units are mounted on the horizontal part of the frame. Preferably, the horizontal part comprises a guide track and at least one of the tong units, preferably, the non-rotational tong unit, is movably mounted on the track to vary the horizontal distance between the tong units. The tong unit is preferably mounted on a carriage, the position of which is adjusted by an appropriate drive arrangement, such as, for example, a hydraulically powered chain drive mechanism.

Preferably, the central openings of the tong units are substantially coaxial.

According to a second aspect of the invention there is provided an apparatus for connecting elongate components, the apparatus comprising at least one rotational tong unit for receiving, gripping and rotating a elongate component for connecting the elongate component with another elongate component end-to-end, the tong unit defining a central opening where the respective elongate component is gripped and comprising a fixed part and a rotary part having at least one gripping member for gripping the elongate component, the rotary part being arranged to rotate in relation to the fixed part in order to rotate the gripped elongate component;

wherein the rotary part comprises an actuator for acting upon the gripping member in order to grip or release the elongate component; and a power source operatively connected to the actuator for energising the actuator to enable the actuator to act upon the gripping member irrespective of whether the rotary part is rotating or at rest; and wherein a control mechanism for controlling the actuator and the power source is provided.

Such an arrangement provides a significant advantage over prior art tong machines in which the gripping elements are powered from the fixed part and, accordingly, the elongate components can only be gripped or released when the rotary part is stationary and connected to the fixed part. In contrast with prior art tong units, in the apparatus of the present invention the actuator is powered by a power source located on the rotary part and therefore, the gripping force exerted on the elongate component can be varied during rotation. The ability to control, i.e. to maintain, monitor and adjust, the gripping force in real time, i.e. while the rotary part is rotating, is a significant advantage over prior art because it is very important not to overcompress the elongate components during rotation. Even slight overcompression can irreparably damage the elongate components. The apparatus of the present invention allows the occurrence of damaged elongate components to be eliminated or at least reduced significantly.

In a preferred arrangement, the invention according to the first aspect incorporates one or more features of the invention in accordance with the second aspect and vice versa. Accordingly, the foregoing description is relevant to either or both the first and the second aspect of the invention where appropriate as will be readily understood by a person skilled in the art.

Preferably, the apparatus according to the first aspect comprises the rotational tong unit of the second aspect and the apparatus of the second aspect comprises the non-rotational tong unit of the first aspect.

Preferably, the non-rotational tong unit has a fixed part and a least one gripping member on the fixed part for gripping the elongate component, and the fixed part further comprises an actuator for acting upon the gripping member in order to grip or release the elongate component, and a power source for energising the actuator to enable the actuator to act upon the gripping member.

In principle, the present invention is suitable for connecting any type of elongate components which have cooperating screw thread arrangements on corresponding male and female parts of the elongate components and which need to be rotated relative to each other in order to establish the connection between the male and female parts. Specifically however, the present invention is particularly useful for connecting various components used in oil and gas drilling, completion and production operations. These components include, for example, tubular components, such as downhole tubing, also known in the industry as tubulars and including, but limited thereto, parts of drillstring, such as drillpipes in drilling, casing or liner in completions or pipeline in production. Indeed, the elongate components may equally be non-tubular, i.e. solid, or partially tubular/partially solid, including, but not limited thereto, drill rods or downhole tool components, such as, for example, valves, sliding sleeves, drill bits, reamers, collars etc., or their subcomponents.

Furthermore, the term "power source" need not be interpreted as being limited only to a source of electric power and indeed includes a source of any type of energy either capable to be converted into a mechanical force to drive the actuator or providing a direct mechanical output.

Preferably, the rotational tong unit and/or the non-rotational tong unit comprise four gripping members, but may comprise more or fewer gripping members. The gripping member preferably comprises a suitably configured gripping head or a die holder. If several gripping members are provided, each gripping member is preferably provided with a corresponding actuator for acting upon the gripping member. Preferably, the gripping member is removably mounted on the rotary part.

In a preferred arrangement, the actuator comprises a hydraulic cylinder having a housing and a piston with a rod. In one arrangement, in the rotational tong unit, a free end of the rod of the piston is fixed to the rotary part, and an end of the housing opposite the free end of the rod mounts the gripping member. In the non-rotational tong unit, the free end of the rod of the piston is preferably fixed to the fixed part, and the end of the housing opposite the rod end mounts the gripping member. The hydraulic cylinder may be a telescopic (multi-stage) cylinder having two or more stages. Preferably, the stages of the telescopic cylinder have equal areas so that a fixed pressure applied to the hydraulic cylinder will result in a constant gripping force exerted by the gripping member on the elongate component, irrespective of which stage of the cylinder is extending.

Preferably, the power source of the rotary part of the rotational tong unit is an autonomous power source, such as, for example a battery, preferably, a rechargeable battery installed on the rotary part and operatively connected to the actuator. In one arrangement the battery is connectable, for example, via a stabbing connection, to an external power source located on another part of the apparatus or external to the apparatus for recharging the battery every time the rotary part is at rest.

Preferably, the rotary part of the rotational tong unit comprises a gauge means for measuring the force exerted by the gripping member on the elongate component.

Where the actuator comprises a hydraulic cylinder, a pump and a hydraulic accumulator reservoir are preferably provided on the rotary part operatively connected with the hydraulic cylinder and the power source for pressuring/depressurising the cylinder. The hydraulic cylinder preferably includes a valve, such as, for example, a poppet valve, arranged in communication with the hydraulic accumulator reservoir, the valve being operable to allow the hydraulic fluid enter the cylinder from the hydraulic accumulator reservoir until desired pressure is achieved or to allow the hydraulic fluid exit the cylinder to depressurise the cylinder. The valve preferably includes a drive means for opening and closing the valve. The drive means is preferably powered by the power source of the rotary part. The drive means may include an electromechanical drive, such as a solenoid drive. The gauge means in this case may include a pressure gauge for measuring the pressure in the hydraulic cylinder, such as, for example, a pressure transducer.

Preferably, the control mechanism is a wireless control mechanism located spaced from the rotary part of the rotational unit for controlling the actuator and the power source irrespective of whether the rotary part is rotating or not. Preferably, the control mechanism is mounted on a stationary part of the apparatus, such as, for example the fixed part of the rotational unit or at another location adjacent the apparatus. Preferably, the control mechanism comprises a control unit, preferably an electronic programmable control unit, for controlling the force exerted by the gripping member on the elongate component. Preferably, the control unit is arranged in wireless communication with the gauge means, the actuator and the power source to exchange wireless signals therewith via, for example, a transceiver provided on the rotary part, and to thereby control, i.e. monitor, maintain or adjust, the force exerted by the gripping member on the elongate component irrespective of whether the rotary part is rotating or at rest. Preferably, the control unit is configured to receive and process data from the gauge means indicative of the force exerted by the gripping member on the elongate component and to generate an appropriate command for the actuator and/or the power source responsive to the data received from the gauge means. Where the actuator comprises a hydraulic cylinder, the control unit is configured to control the pressure in the cylinder, by controlling the pump and to thereby control the force exerted by the gripping member on the elongate component.

Preferably, the power source, the actuator and the control mechanism of the rotational unit form part of an auxiliary system for gripping or releasing the elongate component and for controlling the gripping force exerted by the actuator on the elongate component when the rotary part is rotating.

Preferably, the rotational unit comprises a main system for gripping or releasing the elongate component, the main system comprising a main power source located on a stationary part of the apparatus or external to the apparatus, for example, on the fixed part of the rotational unit, the main power source being operatively connectable to the actuator when the rotary part is at rest for energising the actuator to enable the actuator to act upon the gripping member when the rotary part is rotating and the power source is disconnected from the rotary part; a main control mechanism for controlling the actuator and the main power source; and a locking means for locking the actuator in a position in which it acts upon the gripping member which grips the elongate component so that the power source can be disconnected from the actuator to enable rotation of the rotary part. Thus, when the rotary part is at rest, the main system is connected with the rotary part and the actuator is energised. The locking means then locks the actuator in the energised state and the main system is then disconnected from the rotary part so that the rotary part can rotate relative to the fixed part. When the rotary part is rotating, the auxiliary system is used to control, i.e. monitor, maintain or adjust, the force exerted by the gripping member on the elongate component.

Where the actuator comprises a hydraulic cylinder, a main pump and a main hydraulic accumulator reservoir are preferably provided on a stationary part of the apparatus or externally relative to the apparatus, but preferably on or near the fixed part of the rotational unit, and are operatively connected with the main power source. Preferably, the main pump and the main hydraulic accumulator reservoir are operatively connectable with the hydraulic cylinder for pressuring/depressurising the cylinder when the rotary part is at rest and are disconnected from the rotary part before rotation starts. The locking means for locking the actuator in a position in which it acts upon the gripping member which grips the elongate component may comprise one or more valves provided in the hydraulic cylinder to maintain pressure in the hydraulic cylinder during rotation once the pressure has been set by the main system. The one or more valves may, for example, comprise pilot operated valves fitted in the cylinders. When the rotary part is at rest, the hydraulic cylinder is in fluid communication with the main hydraulic reservoir via a fluid connection arrangement. In the arrangement where the free end of the rod of the piston is fixed to the rotary part, the fluid connection of the cylinder with the main hydraulic reservoir may be arranged through the rod.

Where the actuator comprises a hydraulic cylinder, the auxiliary system is used to control, i.e. monitor, maintain or adjust, the hydraulic pressure in the cylinder when the main hydraulic supply is disconnected to thereby control the force exerted by the gripping member on the elongate component during rotation of the rotary part.

In a preferred arrangement, the auxiliary system is used as a top up system to increase the force exerted by the gripping member on the elongate component depending on the torque exerted on the elongate component as the rotary part rotates. It has been discovered that gripping the elongate component with maximum force before the rotary part starts rotating can distort the joint between the gripping member and the elongate component and prevent the desired torque from being achieved during rotation. To prevent this, the main system energises the actuator so that the actuator causes the gripping member to grip the elongate component with a lower force than required for connecting the elongate components. When the required make up or break out torque is achieved, the auxiliary system is activated via the control mechanism to energise the actuator to raise the gripping force to that appropriate for the torque being applied. No distortion of the joint will occur between the gripping member and the elongate component at this point.

Preferably, the rotary part of the rotational tong unit is rotatably mounted on the fixed part via a bearing arrangement. In one embodiment, the bearing arrangement comprises a plurality of rollers which support the rotary part and allow the rotary part to rotate. The bearing arrangement also centres the rotary part correctly on the fixed part.

Each tong unit is preferably fabricated from high strength steel plate and section, fully welded throughout. Sliding surfaces of the hydraulic cylinder components are machined to a suitable surface finish. The surfaces of the bearing arrangement on the rotational ting unit are also machined.

Preferably, the rotational tong unit has a central opening where the respective elongate component is gripped, the central opening having a substantially horizontal central axis and a side access opening for inserting the elongate component into the central opening radially relative to the central axis. Preferably each of the fixed part and the rotary part include a central opening and a side access opening. The central openings of the rotary part and the fixed part are aligned at all times, whereas the side access openings of the rotary part and the fixed part are aligned to allow a elongate component to be inserted in the central opening when the rotary part is at rest. The side access opening of the fixed part preferably faces upwards so that the side access opening of the rotary part also faces upwards when the side access openings of the fixed part and the rotary part are aligned. When the rotary part is rotating, the side access openings of the rotary part and the fixed part rotate relative to each other and are therefore mostly misaligned except for once per revolution of the rotary part. A locking arrangement is preferably provided to lock the fixed part and the rotary part together when the rotary part is not rotating and the side access openings of the fixed part and the rotary part are aligned to allow elongate components to be fed into the rotational tong unit. The locking arrangement may comprise a locking pin, for example, hydraulically driven pin. A closure element may be provided to close the side access opening of one or each of the rotary part and the fixed part so that the central opening is closed around 360°. The closure element can be hingedly mounted on the fixed part or the rotary part.

The rotational unit preferably comprises a drive to rotate the rotary part relative to the fixed part. The drive may be installed on the fixed part. The drive may comprise a hydraulic motor, for example, of a dual displacement type, to suit different requirements of low torque, high speed, for rotating the elongate component and low speed to stall and high torque when increasing torque on the elongate components being connected or breaking the connection between the elongate components. Preferably a pair of drives is provided to generate greater torque. The drive is preferably connected to the rotary part via a transmission mechanism having a first part mounted on the fixed part and a second part mounted on the rotary part, the transmission mechanism being configured to remain engaged through a full revolution of the rotary part, thereby allowing the rotary part to be rotated continuously. In particular, the first part of the transmission mechanism defines a circumferential line of engagement for connecting the first and second part of the transmission mechanism and the length of the circumferential line of engagement is greater than the length of an arc of the same diameter having a chord equal the width of the side access aperture. Accordingly, the first and second parts will remain engaged even when the access opening on the rotary part passes along the first part of the transmission mechanism. In one arrangement, the first part of the transmission mechanism comprises one or more driving gears on the fixed part which are rotated by the drive and the second part comprises a driven gear on the rotary part which meshes with the driving gears along a circumferential line of engagement which is greater than an arc of the same diameter having a chord equal the width of the side access aperture. For example, two drives and three gears may be provided on the fixed part spaced circumferentially on the fixed part such that each drive meshes with two of the three gears and a bull gear may be provided on the rotary part having cogs arranged around a full circumference on the rotary part save for a gap having a width substantially corresponding to the width of the side access aperture. The gears and the bull gear are arranged such that at least two gears mesh with the bull gear at all times. Preferably, the gears meshing with the bull gear define a circumferential line of engagement and the length of the circumferential line of engagement is greater than the length of an arc of the same diameter having a chord equal the width of the side access aperture. A chain or a caterpillar transmission may be also used.

The tong apparatus of the invention is particularly suitable to make and break elongate component connections away from the rig floor. Most conventional tong machines are used on rigs and therefore they are vertically oriented to save space. Their disadvantage is that elongate components need to be turned from horizontal to vertical position resulting in handling inconvenience. The apparatus of the present invention is preferably double top loading. Therefore it is much quicker to load both elongate components into the apparatus without the need to change the orientation of the elongate components. The tong apparatus of the invention is also suitable for on-rig use, including offshore, as it provides safer and more controlled environment for off-line assembly with minimal impact on deck surface. The apparatus can handle much greater range of diameters compared to prior art machines and can accommodate elongate components from ø23/8" (3.4 cm) to ø22" (55 cm) with no mechanical alterations. The apparatus provides the ability to control, i.e. monitor, maintain and adjust, the gripping force while the rotary part is rotating, whereas in prior art arrangements the gripping force is set before the rotary part is disconnected from the fixed part in order to be able to rotate and the gripping force cannot be altered.

According to a third aspect of the invention there is provided a method of connecting elongate components, the method comprising the steps of a) providing an apparatus comprising a pair of tong units for receiving and gripping respective elongate components and connecting the elongate components end-to-end, wherein at least one of the tong units is adapted to rotate the gripped elongate component;

wherein each of the first and second tong units defines a central opening where the respective elongate component is gripped, the central opening having a substantially horizontal central axis and a side access opening for inserting the elongate component into the central opening radially relative to the central axis;

wherein the tong units are spaced apart substantially horizontally; and b) inserting elongate components to be connected into the tong units in a substantially horizontal orientation and causing the elongate components to be gripped in the tong units in the same substantially horizontal orientation.

In one arrangement, the side access openings face substantially sideways (preferably in a direction substantially parallel to a surface on which the apparatus of the present invention rests during normal use), and the method preferably comprises the step of bringing the elongate components to be connected approximately level with the side access openings in a substantially horizontal orientation and then moving the elongate components on the tong units to enter the side access openings and the respective central openings, and/or moving the elongate components off the tong units in the same substantially horizontal orientation. The elongate components can be moved on the tong units coupled together and moved off decoupled from each other or moved on not coupled and moved off coupled. The step of moving may include rolling the elongate components.

In a further arrangement, the side access openings of the tong units face substantially upwardly (preferably in a direction substantially perpendicular to a surface on which the apparatus of the present invention rests during normal use), and the method preferably further comprises the step of bringing (e.g. by lifting) the elongate components above the tong units in a substantially horizontal orientation and then lowering or dropping the elongate components into the respective central openings of the tong units through the side access openings in the same substantially horizontal orientation.

According to a fourth aspect of the invention there is provided a method of connecting elongate components, the method comprising the steps of a) providing an apparatus comprising at least one rotational tong unit for receiving and gripping a elongate component for connecting the elongate component with another elongate component end-to-end, the tong unit defining a central opening where the respective elongate component is gripped and comprising a fixed part and a rotary part having at least one gripping member for gripping the elongate component, the rotary part being arranged to rotate in relation to the fixed part in order to rotate the gripped elongate component; wherein the rotary part comprises an actuator for acting upon the gripping member in order to grip or release the elongate component; and a power source operatively connected to the actuator;

b) energising the actuator by the power source to cause the actuator to act upon the gripping member irrespective of whether the rotary part is rotating or at rest; and c) controlling the actuator and the power source by means of a control mechanism.

Preferably, the control mechanism is a wireless control mechanism and the method includes wirelessly controlling the power source and the actuator as described above in connection with the second aspect of the invention.

Preferably, the power source, the actuator and the control mechanism of the rotational unit form part of an auxiliary system for gripping or releasing the elongate component and for controlling the gripping force exerted by the actuator on the elongate component when the rotary part is rotating and the rotational unit comprises a main system for gripping or releasing the elongate component; wherein the method includes using the auxiliary system as a top up system to increase the force exerted by the gripping member on the elongate component depending on the torque exerted on the elongate component as the rotary part rotates as described in connection with the second aspect of the invention.

All essential, preferred or optional features of the first aspect of the present invention can be provided in conjunction with one or more of the second, third and fourth aspects of the present invention and vice versa where appropriate.

DETAILED DESCRIPTION OF THE INVENTION

Embodiments of the present invention will now be described, by way of example only, with reference to the accompanying drawings in which.

Figure 1:
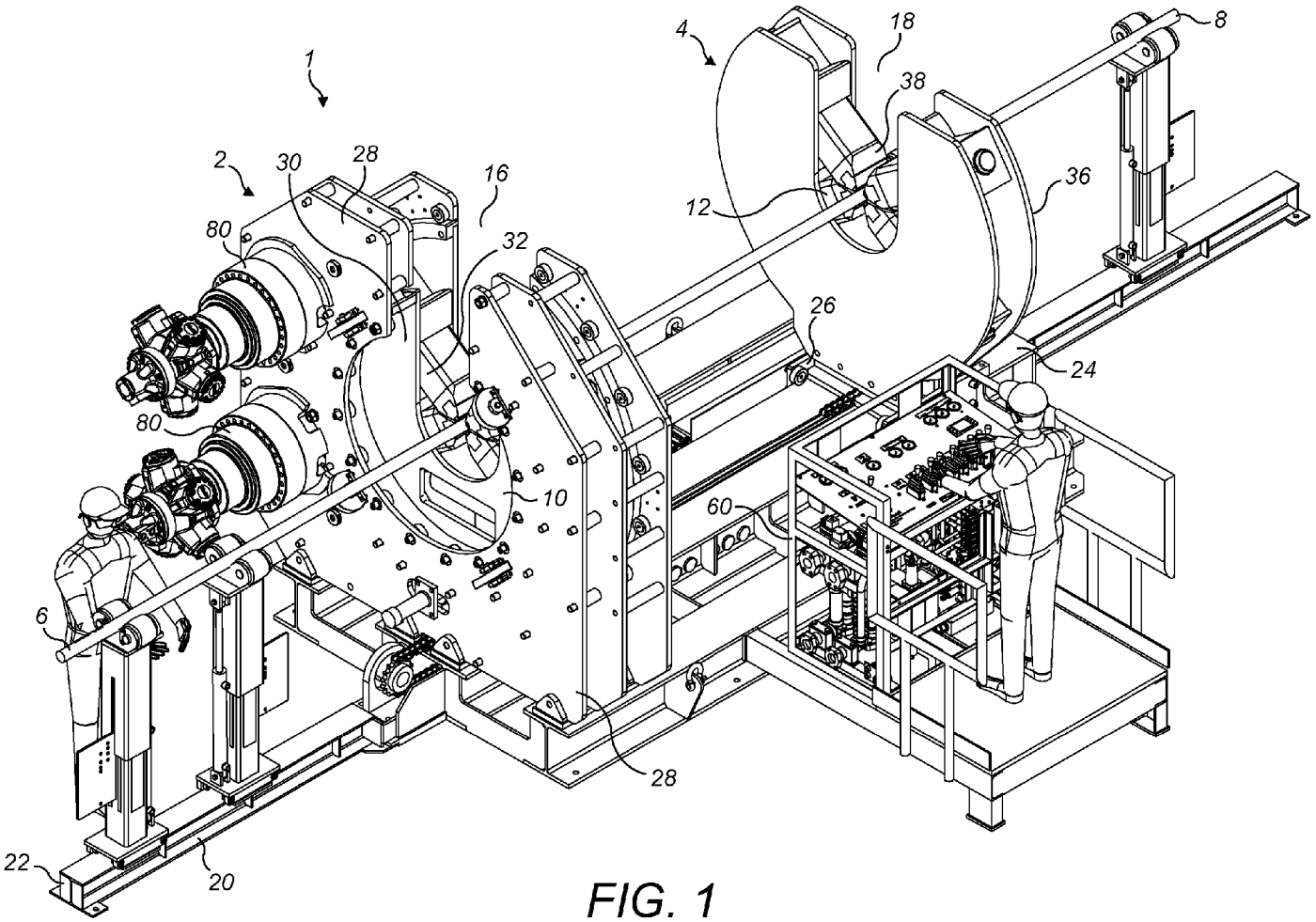
FIGS. 1, 2 and 3 are, respectively, a perspective, a side and a top view of the apparatus in accordance with the invention.
Figure 2:
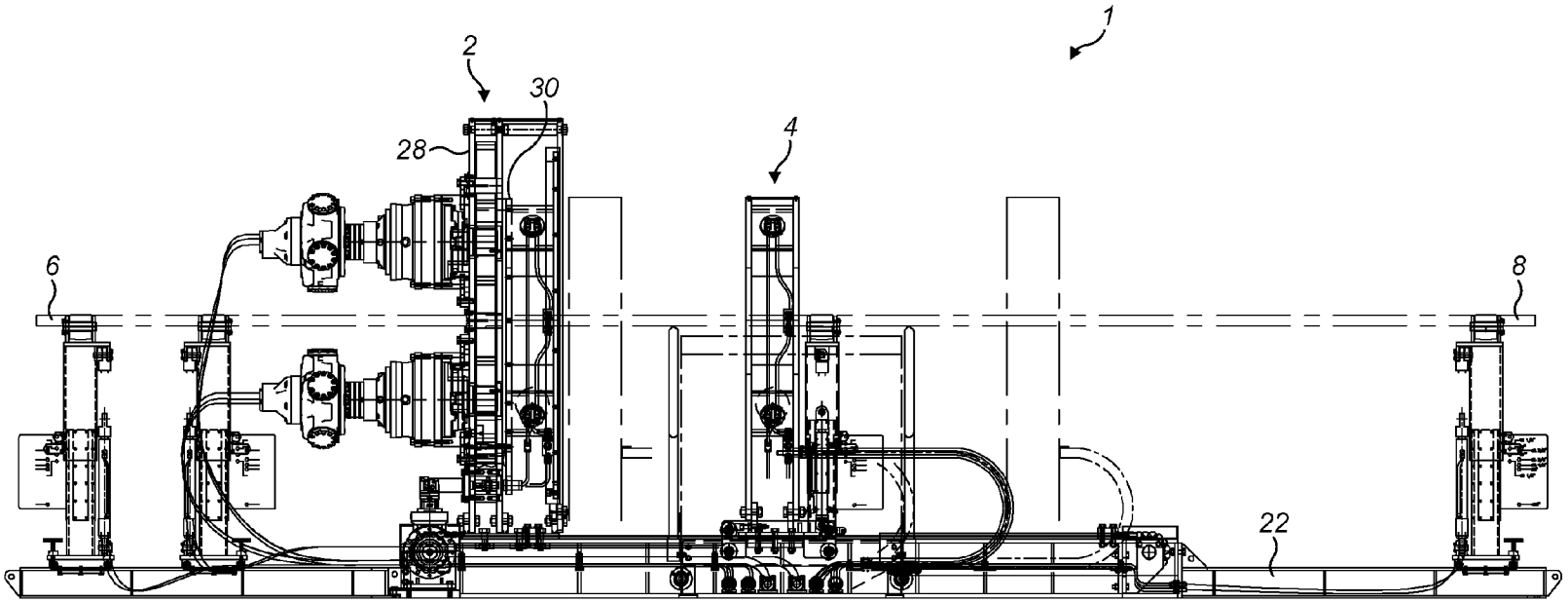
Figure 3:
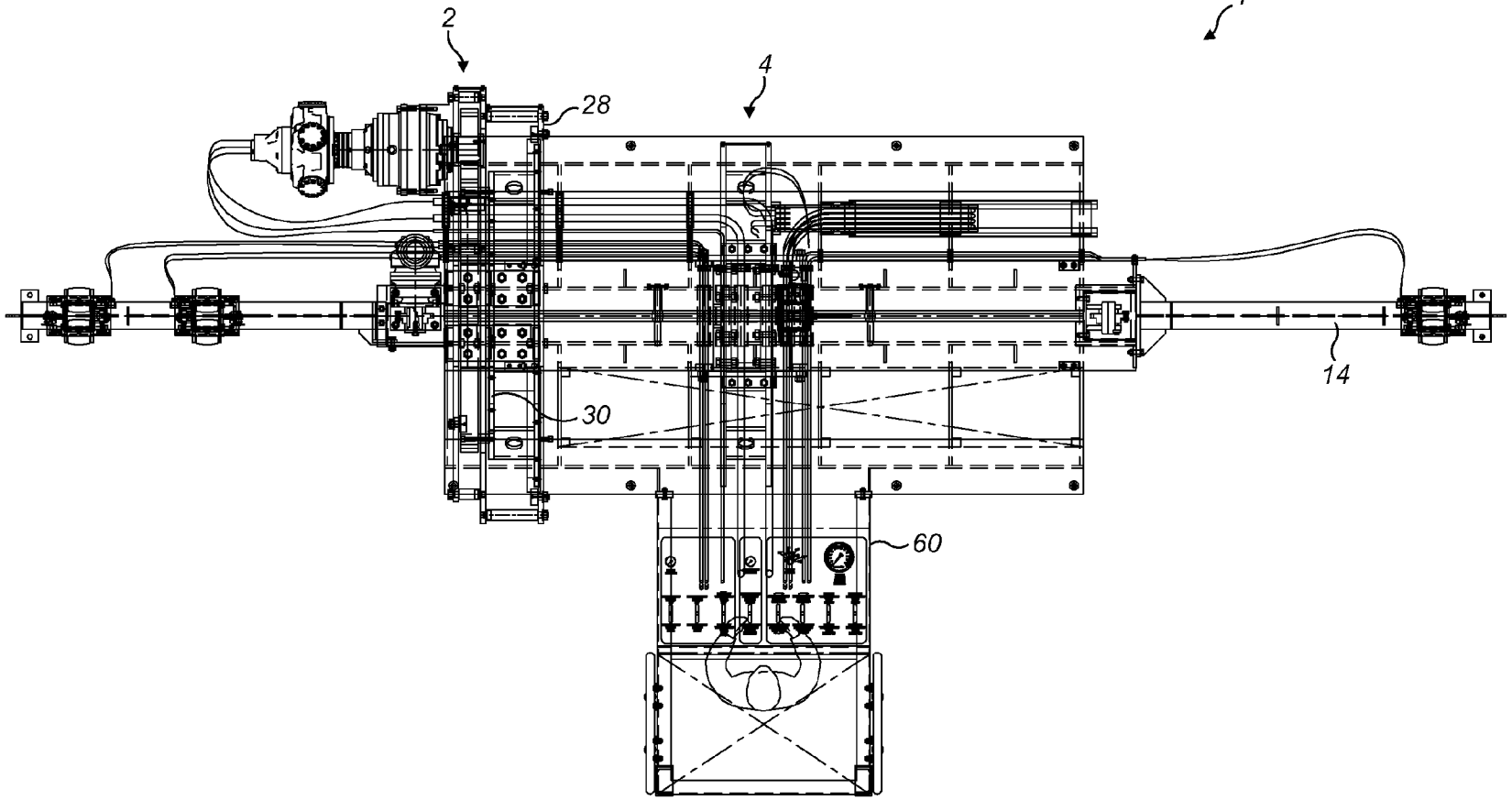

Referring initially to FIGS. 1 to 3, an apparatus for connecting elongate components in accordance with the present invention is indicated generally by reference numeral 1. In the presently described embodiment, the elongate components comprise downhole tubing components or "tubulars". It will however be appreciated, that, as stated above, the apparatus described is equally well suitable or readily adjustable for connecting any type of elongate components which have cooperating screw thread arrangements on corresponding male and female parts of the elongate components and which need to be rotated relative to each other in order to establish the connection between the male and female parts. The apparatus 1 comprises a pair of tong units 2, 4 for receiving and gripping respective tubulars 6, 8 and connecting the tubulars 6, 8 end-to-end. The tong unit 2 is a rotational tong unit adapted to receive, grip and rotate the first tubular 6. The tong unit 4 is a non-rotational unit which simply receives and grips the second tubular 8 while the first tubular 6 is being rotated by the rotational tong unit 2 to make or break the connection between the tubulars 6, 8.

Each of the first and second tong units 2, 4 defines a central opening 10, 12 where the respective tubular 6, 8 is gripped. The central openings have a substantially horizontal common central axis 14 (FIG. 3) and each tong unit 2, 4 includes a respective side access opening 16, 18 for inserting the respective tubular 6, 8 into the central opening 10, 12 radially relative to the central axis 14. The tong units 2, 4 are spaced apart substantially horizontally and the side access openings 16, 18 face substantially upwardly (in this case, substantially perpendicular to a surface on which the apparatus 1 rests during normal use) so that the tubulars 6, 8 to be connected can be lifted above the tong units 2, 4 in a substantially horizontal orientation and then lowered or simply dropped into the respective central openings 10, 12 through the side access openings 16, 18 and then gripped in the tong units 2, 4 in the same substantially horizontal orientation. Accordingly, both tubulars 6, 8 can be raised in the same horizontal orientation in which they are stored.

Figure 7:
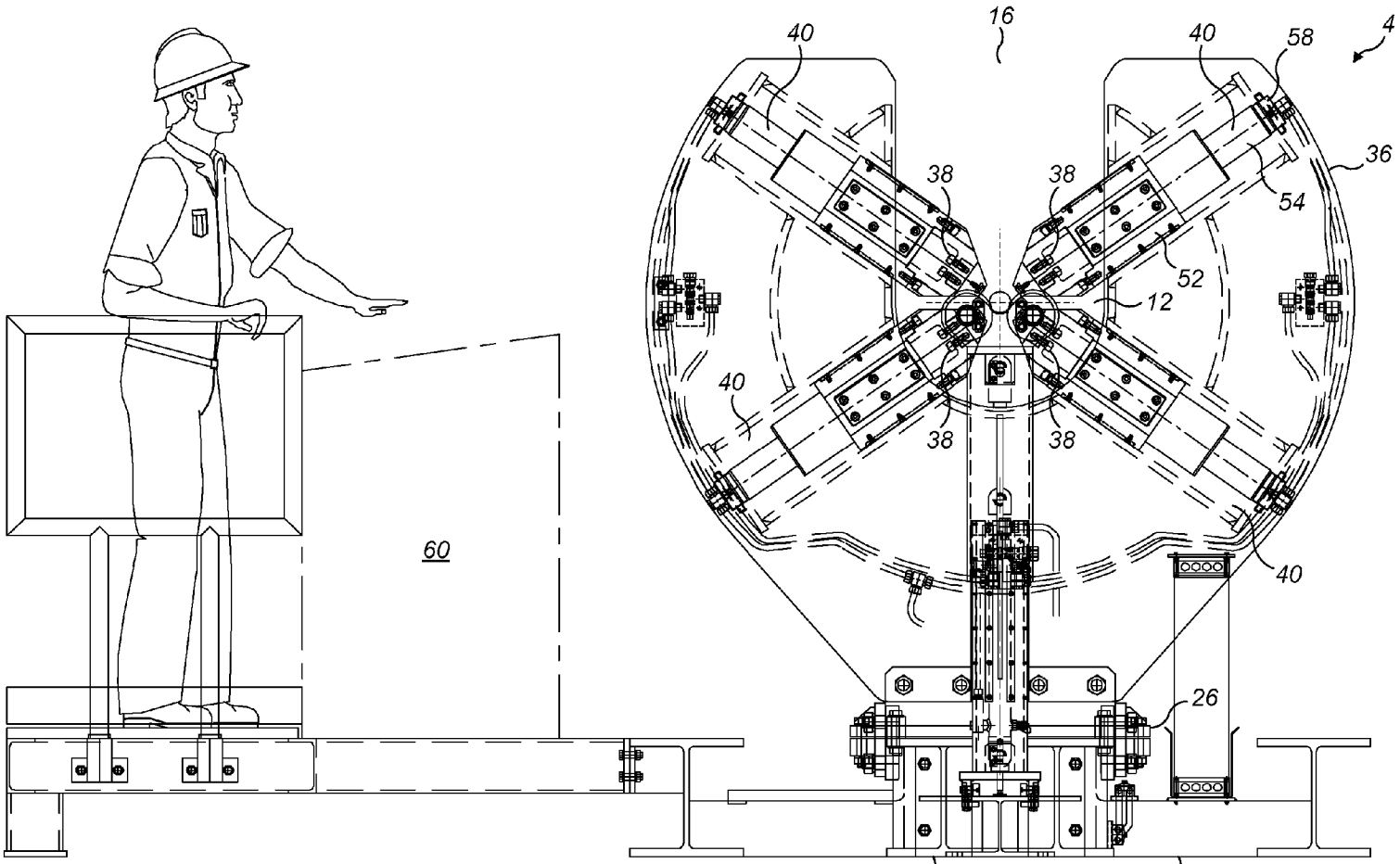
FIG. 7 is an end elevation of a non-rotational tong unit of the apparatus of FIGS. 1 to 3.

Referring also to FIGS. 2 and 7, the apparatus 1 comprises a frame 20 having a substantially horizontal part 22 and the tong units 2, 4 are mounted on the horizontal part 22 of the frame 20. The horizontal part comprises a guide track 24 and the non-rotational tong unit 4 is movably mounted on the track 24 to vary the horizontal distance between the tong units 2, 4. The non-rotational tong unit 4 is preferably mounted on a carriage 26, the position of which is adjusted by a hydraulically powered chain drive mechanism parts of which are visible in FIGS. 1, 2 and 7.

Figure 4:
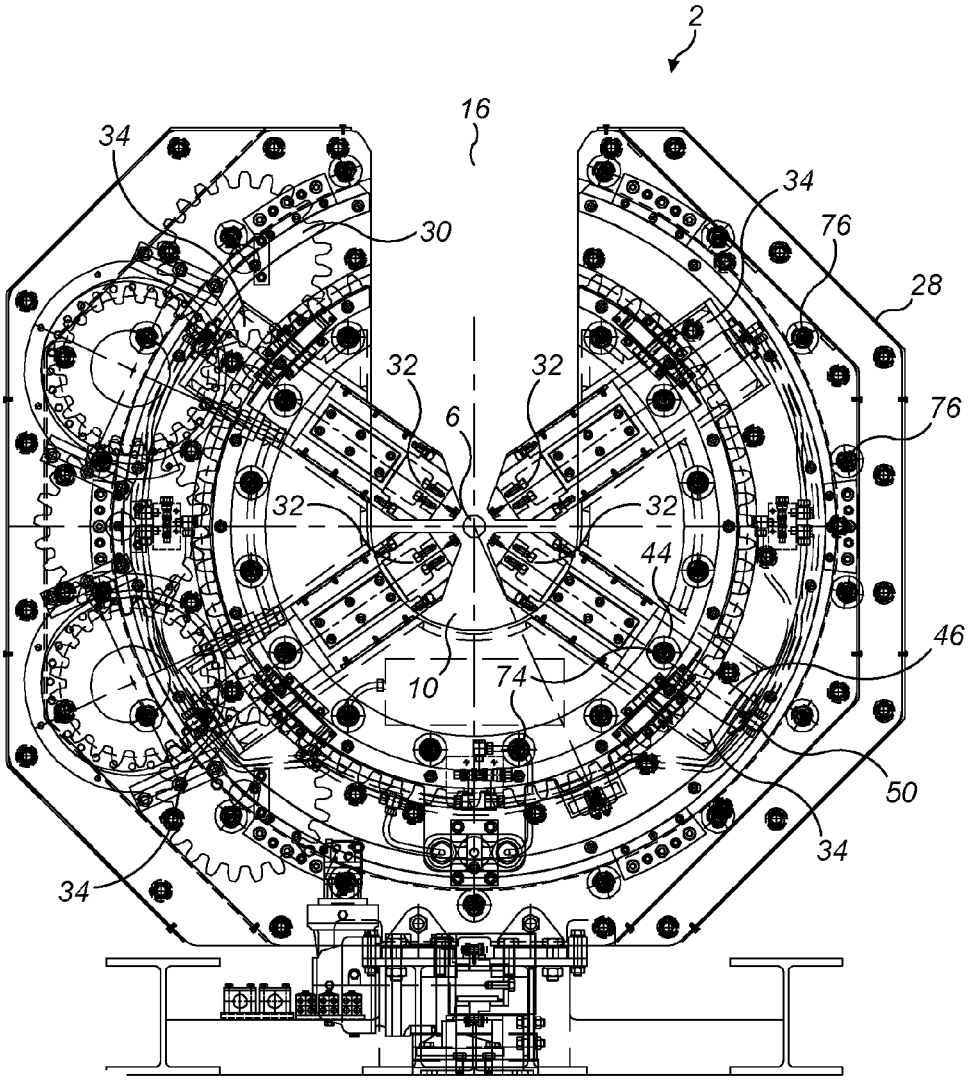
FIG. 4 is an end elevation of a rotational tong unit of the apparatus of FIGS. 1 to 3 showing gripping heads for gripping a elongate component and hydraulic cylinders for operating the gripping heads.

Now also referring to FIG. 4, the rotational ting unit 2 comprises a fixed part 28 and a rotary part 30 having four removable gripping heads 32 for gripping the tubular 6. The rotary part 30 is arranged to rotate in relation to the fixed part 28 in order to rotate the gripped tubular 6 as will be described below. The rotary part 30 comprises four actuators in the form of hydraulic cylinders 34 for acting upon the respective gripping heads 32 in order to grip or release the tubular 6.

As will be described in more detail below, the rotary part 30 comprises a power source operatively connected to the hydraulic cylinders 34 for pressurising/depressurising the hydraulic cylinders 34 to enable the hydraulic cylinders 34 to act upon the gripping heads 32 irrespective of whether the rotary part 30 is rotating or not; and a wireless control mechanism for controlling hydraulic cylinders 34 and the power source. The power source on the rotary part 30, the hydraulic cylinders 34 and the control mechanism of the rotational unit 2 form part of an auxiliary system for gripping or releasing the tubular 6 and for controlling the gripping force exerted by the hydraulic cylinders 34 on the tubular 6 when the rotary part 30 is rotating as will be described below.

As shown in FIG. 7, the non-rotational tong unit 4 has a fixed part 36 and four gripping heads 38 similar to those of the rotational unit 2. The gripping heads 38 are removably arranged on the fixed part 36 for gripping the tubular 8. The fixed part 36 further comprises respective hydraulic cylinders 40 for acting upon the gripping heads 38 in order to grip or release the tubular 8, and a pump (not shown) for operating the hydraulic cylinders 40.

Each hydraulic cylinder 34 of the rotary part 30 of the rotational unit 2 has a housing 44 and a piston (not visible) with a rod 46. Each hydraulic cylinder 40 of the non-rotational unit 4 has a housing 52 and a piston (not visible) with a rod 54. The rod 46 of the hydraulic cylinder 34 has a free end 50 fixed to the rotary part 30, and an end of the housing 44 opposite the free end 50 of the rod 46 mounts the gripping head 32. In the non-rotational tong unit 4, free end 58 of the rod 54 of the piston is fixed to the fixed part 36, and the end of the housing 52 opposite the rod end 58 mounts the gripping head 38. The hydraulic cylinders 34, 40 are telescopic (multi-stage) cylinder having two stages but more stages may be provided if required). Preferably, the stages of the hydraulic cylinders 34, 40 have equal areas so that a fixed pressure applied to the hydraulic cylinder 34, 40 results in a constant gripping force exerted on by the gripping heads 32, 38 on the tubulars 6, 8 irrespective of which stage of the cylinder 34, 40 is extending.

The rotational unit 2 comprises a main system (not shown) for gripping or releasing the tubular 6. The main system comprises a main power source, including a main pump, a drive to drive the pump and a main hydraulic reservoir located on a stationary part of the apparatus 1 or external to the apparatus 1, preferably on or near the fixed part 28. The main pump and the main hydraulic accumulator reservoir are operatively connectable with the hydraulic cylinders 34 for moving their respective pistons with respect to the housings 44 by pressuring/depressurising the cylinders 34 when the rotary part 30 is at rest. The main pump and the main hydraulic accumulator reservoir are disconnected from the rotary part 30 before rotation starts. A control mechanism is provided within control panel 60 for controlling the hydraulic cylinders 34 and the main power source when the hydraulic cylinders 34 are connected with the main power source when the rotary part 30 is not rotating. The main system comprises a locking means provided in the form of respective pilot operated valves (not shown) provided in the respective hydraulic cylinders 34 for locking the hydraulic cylinders 34 to maintain pressure in the hydraulic cylinders 34 during rotation. Once the pressure has been set by the main system while the rotary part 30 is at rest, the main power source can be disconnected from the hydraulic cylinders 34 to enable rotation of the rotary part 30. When the rotary part 30 is at rest the hydraulic cylinders 34 are in fluid communication with the main hydraulic reservoir via fluid connections in the free ends 50 of the rods 46 of the hydraulic cylinders 34.

When the rotary part 30 is rotating, the auxiliary system mentioned above is used to control, i.e. monitor, maintain or adjust, the hydraulic pressure in the cylinders 34 when the main hydraulic supply is disconnected to thereby control the force exerted by the gripping heads 32 on the tubular 6 during rotation of the rotary part 30. More specifically, the auxiliary system is used as a top up system to increase the force exerted by the gripping heads 32 on the tubular 6 depending on the torque exerted on the tubular as the rotary part 30 rotates. Gripping the tubular 6 with maximum force before the rotary part 30 starts rotating can distort the joint between the gripping heads 32 and the tubular 6 and prevent the desired torque from being achieved during rotation. To prevent this, the main system energises the hydraulic cylinders 34 so that the hydraulic cylinders 34 cause the gripping heads 32 to grip the tubular 6 with a lower force than required for connecting the tubulars 6, 8. When the required make up or break out torque is achieved, the auxiliary system is activated via the wireless control mechanism to energise the hydraulic cylinders 34 to raise the gripping force to that appropriate for the torque being applied. Thus, no distortion of the joint occurs between the gripping heads 32 and the tubular 6 at this point.

Figure 5:
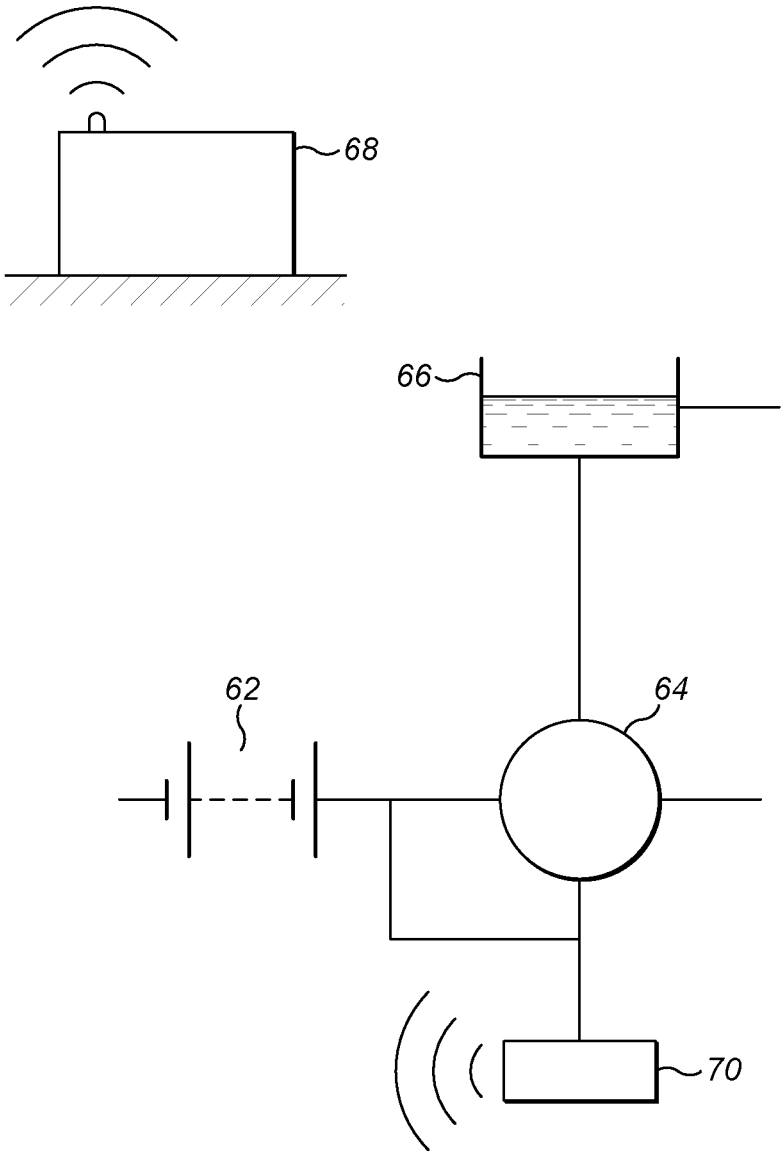
FIG. 5 is a schematic illustration of a control mechanism for controlling the hydraulic cylinders.

Referring now to FIG. 5, the power source of the rotary part 30 of the rotational tong unit 2 is an autonomous power source, such as, for example, a rechargeable battery 62, installed on the rotary part 30 and operatively connected to the hydraulic cylinders 34. The battery 62 is connectable, for example, via a stabbing connection (not shown), to an external power source located on another part of the apparatus or external to the apparatus, for recharging the battery 62 every time the rotary part 30 is at rest. An auxiliary pump 64 and an auxiliary hydraulic accumulator reservoir 66 are provided on the rotary part 30 operatively connected with the hydraulic cylinders 34 and the battery 32 for pressuring/depressurising the cylinders 34. Each hydraulic cylinder 34 includes a valve (not shown), such as, for example, a poppet valve, arranged in communication with the auxiliary hydraulic accumulator reservoir 66. The valve is operable to allow the hydraulic fluid enter the cylinders 34 from the auxiliary hydraulic accumulator reservoir 66 until desired pressure is achieved or to allow the hydraulic fluid exit the cylinders 34 to depressurise the cylinder 34. The valve preferably includes a solenoid drive (not shown) powered by the battery 62 for opening and closing the valve. Although not shown in the drawings, the rotary part 30 of the rotational tong unit 2 comprises a gauge means in the form of a pressure transducer (not shown) for measuring the pressure in the hydraulic cylinders 34 during rotation of the rotary part 30. The control mechanism of the auxiliary system is a wireless control mechanism located spaced from the rotary part 30 of the rotational unit 2 within the control panel 60 for controlling the hydraulic cylinders 34 and the battery 62 irrespective of whether the rotary part 30 is rotating or not, but mainly during rotation of the rotary part 30. The control mechanism comprises an electronic programmable control unit 68 within the control panel 60 for monitoring and controlling the pressure in the cylinders 34 by controlling the auxiliary pump 64 and to thereby control the force exerted by the gripping heads 32 on the tubular 6. The control unit 68 is arranged in wireless communication with the pressure transducer, the cylinders 34 and the battery to exchange wireless signals therewith via a transceiver 70 provided on the rotary part 30. The control unit 60 receives and processes data from the transceiver 70 indicative of the force exerted by the gripping heads 32 on the tubular 6 and generates an appropriate command for the auxiliary system responsive to the data received from the transceiver 70.

Referring again to FIG. 4, the rotary part 30 of the rotational tong unit 2 is rotatably mounted on the fixed part 28 via a bearing arrangement provided by a plurality of concentrically arranged rollers 74, 76 which support the rotary part 30 and allow the rotary part 30 to rotate on the fixed part 28. The rollers 74, 76 also centre the rotary part 30 correctly on the fixed part 28.

In the rotational tong unit 2 each of the fixed part 28 and the rotary part 30 include a central opening 10 and a side access opening 16. The central openings 10 of the rotary part 30 and the fixed part 28 are aligned at all times, whereas the side access openings 16 of the rotary part 30 and the fixed part 28 are aligned to allow a tubular 6 to be inserted in the central opening 10 when the rotary part 30 is at rest. The side access opening 16 of the fixed part 28 always faces upwards. Accordingly, the side access opening 16 of the rotary part 30 also faces upwards when the side access openings 16 of the fixed part 28 and the rotary part 30 are aligned. When the rotary part 30 is rotating, the side access openings 16 of the rotary part 30 and the fixed part 28 rotate relative to each other and are therefore mostly misaligned except for once per revolution of the rotary part 30. A locking arrangement in the form of a hydraulically driven pin (not shown) is provided to lock the fixed part 28 and the rotary part 30 together when the rotary part 30 is not rotating and the side access openings 16 of the fixed part 28 and the rotary part 30 are aligned to allow the tubular 6 to be fed into the rotational tong unit 2. A closure element (not shown) can be hingedly mounted on the fixed part 28 or the rotary part 30 to close the side access opening 16 of one or each of the rotary part 30 and the fixed part 28 so that the central opening 10 is closed around 360° during rotation of the rotary part 30.

Although not shown in the drawings, in an advantageous modification, the side access openings 16 face substantially sideways, preferably in a direction substantially parallel to a surface on which the apparatus 1 rests during normal use. In use, the tubulars 6, 8 to be connected are brought (e.g. lifted) approximately level with the side access openings 16 in a substantially horizontal orientation and then moved on the tong units 2, 4 to enter the side access openings 16 and the respective central openings 10, 12. The tubulars 6, 8 are moved off the tong units 2, 4 in the same substantially horizontal orientation. The tubulars 6, 8 can be moved on the tong units 2, 4 coupled together and moved off decoupled from each other or moved on not coupled and moved off coupled. Moving the tubulars 6, 8 may be accomplished through, for example, a rolling action. Both tubulars 6, 8 can be raised level with the side access openings 16 in the same horizontal orientation in which they are stored and then moved on the tong units 2, 4. Similarly, the tubulars 6, 8 can be easily extracted from the tong units 2, 4 by moving the tubulars 6, 8 off the tong units 2, 4 without the need to grip the tubulars 6, 8 securely while the tubulars 6, 8 are still gripped by the by the tong units 2, 4.

Figure 6:
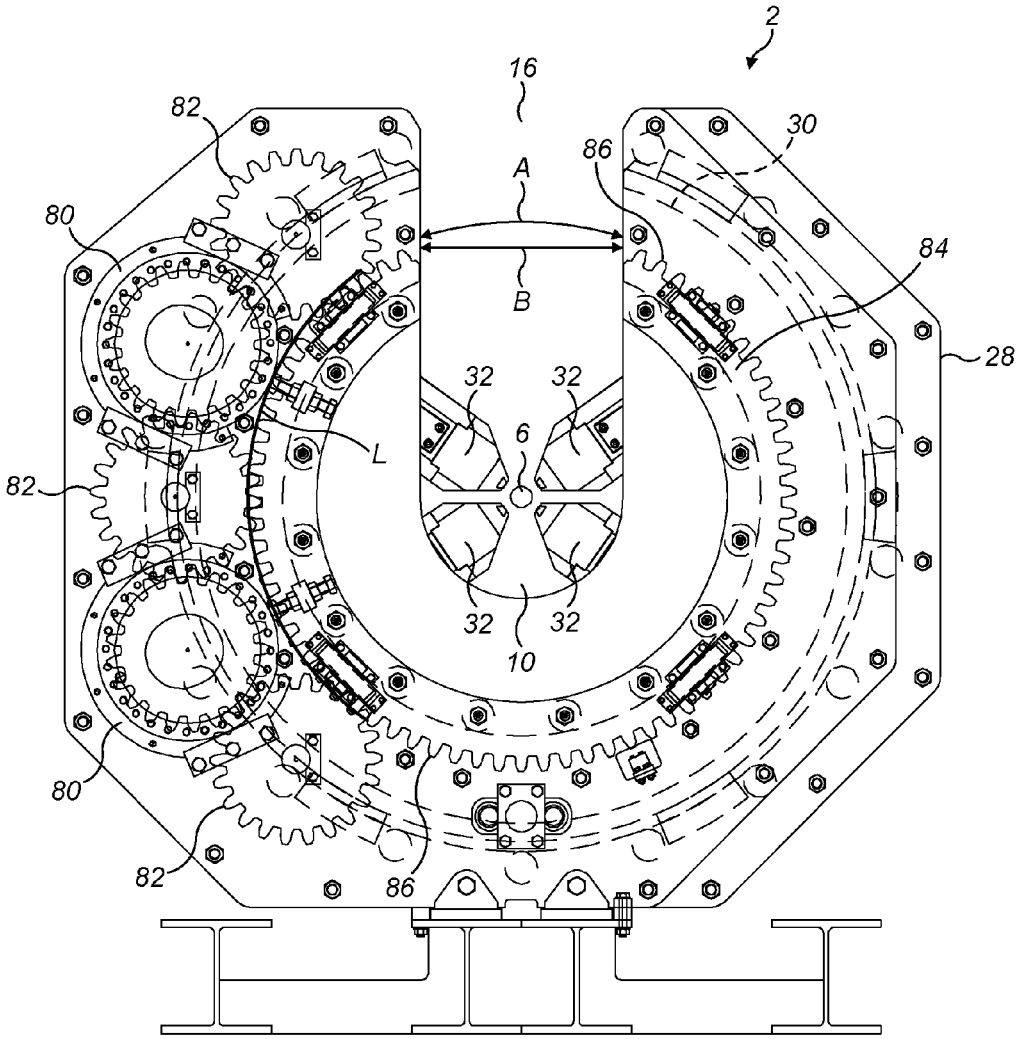
FIG. 6 is an end elevation of the rotational tong unit of FIG. 4 showing a transmission arrangement between fixed and rotary parts of the rotational unit.

Referring now to FIGS. 1 and 6, the rotational tong unit 2 comprises a pair of hydraulic motors 80 of a dual displacement type installed on the fixed part 28 to rotate the rotary part 30 relative to the fixed part 28. The hydraulic motors 80 are connected to the rotary part 30 via three driving gears 82 mounted on the fixed part 28. The hydraulic motors 80 and the three gears 82 are spaced circumferentially on the fixed part 28 such that each hydraulic motor 80 meshes with two of the three gears 82. This arrangement provides for greater and more distributed torque transfer. A bull gear 84 is mounted on the rotary part 30 and has cogs 86 arranged around a full circumference on the rotary part 30 save for a gap of substantially the same width as the side access opening 16. The gears 82 and the bull gear 84 are arranged such that at least two gears 82 mesh with the bull gear 84 at all times thereby allowing the rotary part 30 to be rotated continuously. The gears 82 meshing with the bull gear 84 define a circumferential line L of engagement and the length of the circumferential line of engagement L is greater than the length of an arc A of the same diameter having a chord B equal the width of the side access aperture 16. Accordingly, the gears 82 remain engaged with the bull gear 84 during a full revolution of the rotary part 30 even when the access opening 16 on the rotary part 30 passes along the gears 82.

Whilst specific embodiments of the present invention have been described above, it will be appreciated that modifications are possible within the scope of the present invention.

The invention claimed is:

1. An apparatus for connecting elongate components, the apparatus comprising:

a pair of tong units for receiving and gripping respective elongate components and connecting the elongate components end-to-end, wherein at least one of the tong units is adapted to rotate the gripped elongate component;

wherein each tong unit defines:

a central opening where the respective elongate component is gripped, the central opening having a substantially horizontal central axis, and a side access opening for inserting the elongate component into the central opening radially relative to the central axis;

wherein the tong units are spaced apart substantially horizontally so that the elongate components to be connected are inserted and gripped in the tong units in a substantially horizontal orientation;

wherein the said at least one of the tong units is a rotational tong unit for receiving, gripping and rotating an elongate component for connecting the elongate component with another elongate component end-to-end, the rotational tong unit further comprising:

a fixed part; and a rotary part having at least one gripping member for gripping the elongate component, the rotary part being arranged to continuously rotate around 360 degrees in relation to the fixed part in order to continuously rotate the gripped elongate component around 360 degrees;

wherein the rotary part comprises:

an actuator for acting upon the gripping member in order to grip or release the elongate component;

a power source operatively connected to the actuator for energizing the actuator to enable the actuator to act upon the gripping member irrespective of whether the rotary part is rotating or at rest; and a control mechanism for controlling the actuator and the power source.

2. An apparatus as claimed in claim 1, wherein the side access openings of the tong units face substantially in the same direction.

3. An apparatus as claimed in claim 2, wherein the side access openings face substantially sideways.

4. An apparatus as claimed in claim 2, wherein the side access openings face substantially upwardly.

5. An apparatus as claimed in claim 1, wherein the other tong unit is a non-rotational unit configured to receive and grip the other elongate component.

6. An apparatus as claimed in claim 1, wherein the apparatus comprises a frame having a substantially horizontal part and the tong units are mounted on the horizontal part of the frame, wherein the horizontal part comprises a guide track and at least one of the tong units is movably mounted on the track to vary the horizontal distance between the tong units.

7. An apparatus for connecting elongate components, the apparatus comprising at least one rotational tong unit for receiving, gripping and rotating a elongate component for connecting the elongate component with another elongate component end-to-end, the at least one rotational tong unit defining a central opening where the respective elongate component is gripped and comprising:

a fixed part and a rotary part having at least one gripping member for gripping the elongate component, the rotary part being arranged to continuously rotate around 360 degrees in relation to the fixed part in order to continuously rotate the gripped elongate component around 360 degrees;

wherein the rotary part comprises:

an actuator for acting upon the gripping member in order to grip or release the elongate component;

a power source operatively connected to the actuator for energising the actuator to enable the actuator to act upon the gripping member irrespective of whether the rotary part is rotating or at rest; and a control mechanism for controlling the actuator and the power source;

wherein the control mechanism is a wireless control mechanism located spaced from the rotary part of the at least one rotational tong unit and is adapted to control the actuator and the power source irrespective of whether the rotary part is rotating or not.

8. An apparatus as claimed in claim 7, wherein the apparatus further comprises at least one non-rotational tong unit.

9. An apparatus as claimed in claim 8, wherein the at least one non-rotational tong unit has a fixed part and at least one gripping member on the fixed part for gripping the elongate component, and the fixed part further comprises an actuator for acting upon the gripping member in order to grip or release the elongate component, and a power source for energizing the actuator to enable the actuator to act upon the gripping member.

10. An apparatus as claimed in claim 7, wherein a plurality of gripping members are provided in the at least one rotational tong unit, each gripping member being provided with a corresponding actuator for acting upon the gripping member.

11. An apparatus as claimed in claim 7, wherein the actuator comprises a hydraulic cylinder having a housing and a piston with a rod.

12. An apparatus as claimed in claim 11, wherein the hydraulic cylinder is a telescopic multi-stage cylinder having two or more stages, wherein the stages of the telescopic cylinder have equal areas.

13. An apparatus as claimed in claim 11, wherein a pump and a hydraulic accumulator reservoir are provided on the rotary part operatively connected with the hydraulic cylinder and the power source for pressuring/depressurising the cylinder.

14. An apparatus as claimed in claim 7, wherein the power source of the rotary part of the at least one rotational tong unit is an autonomous power source installed on the rotary part and operatively connected to the actuator.

15. An apparatus as claimed in claim 7, wherein the rotary part of the at least one rotational tong unit comprises a gauge for measuring the force exerted by the gripping member on the elongate component.

16. An apparatus as claimed in claim 15, wherein the control mechanism comprises a control unit for controlling the force exerted by the gripping member on the elongate component.

17. An apparatus as claimed in claim 16, wherein the control unit is arranged in wireless communication with the gauge, the actuator and the power source to exchange wireless signals therewith and to thereby control force exerted by the gripping member on the elongate component irrespective of whether the rotary part is rotating or at rest.

18. An apparatus as claimed in claim 17, wherein the control unit is configured to receive and process data from the gauge indicative of the force exerted by the gripping member on the elongate component and to generate an appropriate command for the actuator and/or the power source responsive to the data received from the gauge.

19. An apparatus as claimed in claim 7, wherein the control mechanism is mounted on a stationary part of the apparatus.

20. An apparatus as claimed in claim 7, wherein the power source, the actuator and the control mechanism of the rotational unit form part of an auxiliary system for gripping or releasing the elongate component and for controlling the gripping force exerted by the actuator on the elongate component when the rotary part is rotating.

21. An apparatus as claimed in claim 20, wherein the rotational unit comprises:

a main system for gripping or releasing the elongate component, the main system comprising a main power source located on a stationary part of the apparatus or external to the apparatus, the main power source being operatively connectable to the actuator when the rotary part is at rest for energising the actuator to enable the actuator to act upon the gripping member when the rotary part is rotating and the power source is disconnected from the rotary part;

a main control mechanism for controlling the actuator and the main power source; and a locking mechanism for locking the actuator in a position in which it acts upon the gripping member which grips the elongate component so that the power source can be disconnected from the actuator to enable rotation of the rotary part.

22. An apparatus as claimed in claim 21, wherein the auxiliary system is adapted to serve as a top up system to increase the force exerted by the gripping member on the elongate component depending on the torque exerted on the elongate component as the rotary part rotates.

23. An apparatus as claimed in claim 7, wherein the at least one rotational tong unit has a central opening where the respective elongate component is gripped, the central opening having a substantially horizontal central axis and a side access opening for inserting the elongate component into the central opening radially relative to the central axis, wherein each of the fixed part and the rotary part include a central opening and a side access opening, wherein the central openings of the rotary part and the fixed part are aligned at all times, whereas the side access openings of the rotary part and the fixed part are aligned to allow a elongate component to be inserted in the central opening when the rotary part is at rest and when the rotary part is rotating, the side access openings of the rotary part and the fixed part rotate relative to each other and are therefore mostly misaligned except for once per revolution of the rotary part.

24. An apparatus as claimed in claim 23, wherein a locking arrangement is provided to lock the fixed part and the rotary part together when the rotary part is not rotating and the side access openings of the fixed part and the rotary part are aligned to allow elongate components to be fed into the at least one rotational tong unit.

25. An apparatus as claimed in claim 7, wherein the at least one rotational tong unit comprises a drive to rotate the rotary part relative to the fixed part, wherein the drive is installed on the fixed part.

26. An apparatus as claimed in claim 25, wherein the drive is connected to the rotary part via a transmission mechanism having a first part mounted on the fixed part and a second part mounted on the rotary part, the transmission mechanism being configured to remain engaged through a full revolution of the rotary part, thereby allowing the rotary part to be rotated continuously.

27. An apparatus as claimed in claim 26, wherein the first part of the transmission mechanism defines a circumferential line of engagement for connecting the first and second part of the transmission mechanism and the length of the circumferential line of engagement is greater than the length of an arc of the same diameter having a chord equal the width of the side access aperture such that the first and second transmission parts remain engaged even when the access opening on the rotary part passes along the first part of the transmission mechanism.

28. An apparatus as claimed in claim 27, wherein the first part of the transmission mechanism comprises one or more driving gears on the fixed part which are rotated by the drive and the second part comprises a driven gear on the rotary part which meshes with the driving gears along a circumferential line of engagement which is greater than an arc of the same diameter having a chord equal to the width of the side access aperture.

29. A method of connecting elongate components, the method comprising:

providing an apparatus comprising a pair of tong units for receiving and gripping respective elongate components and connecting the elongate components end-to-end, wherein at least one of the tong units is adapted to rotate the gripped elongate component;

wherein each tong unit defines:

a central opening where the respective elongate component is gripped, the central opening having a substantially horizontal central axis, and a side access opening for inserting the elongate component into the central opening radially relative to the central axis;

wherein the tong units are spaced apart substantially horizontally;

wherein the said at least one of the tong units is a rotational tong unit for receiving, gripping and rotating an elongate component for connecting the elongate component with another elongate component end-to-end, the rotational tong unit further comprising:

a fixed part; and a rotary part having at least one gripping member for gripping the elongate component, the rotary part being arranged to continuously rotate around 360 degrees in relation to the fixed part in order to continuously rotate the gripped elongate component around 360 degrees;

wherein the rotary part comprises: — an actuator mounted thereon for acting upon the gripping member in order to grip or release the elongate component;

a power source mounted thereon and operatively connected to the actuator for energising the actuator to enable the actuator to act upon the gripping member irrespective of whether the rotary part is rotating or at rest; and a control mechanism for controlling the actuator and the power source;

and inserting elongate components to be connected into the tong units in a substantially horizontal orientation and causing the elongate components to be gripped in the tong units in the same substantially horizontal orientation.

30. A method as claimed in claim 29, wherein the side access openings face substantially sideways, and the method further comprises:

bringing the elongate components to be connected approximately level with the side access openings in a substantially horizontal orientation and then moving the elongate components on the tong units to enter the side access openings and the respective central openings, and/or moving the elongate components off the tong units in the same substantially horizontal orientation.

31. A method as claimed in claim 30, wherein moving the elongate components includes rolling the elongate components.

32. A method as claimed in claim 29, wherein the side access openings of the tong units face substantially upwardly, and the method further comprises:

bringing the elongate components above the tong units in a substantially horizontal orientation and then lowering or dropping the elongate components into the respective central openings of the tong units through the side access openings in the same substantially horizontal orientation.

33. A method as claimed in claim 32, wherein bringing the elongate components above the tong units in a substantially horizontal orientation includes lifting the elongate components.

34. A method of connecting elongate components, the method comprising:

providing an apparatus comprising at least one rotational tong unit for receiving and gripping a elongate component for connecting the elongate component with another elongate component end-to-end, the at least one rotational tong unit defining a central opening where the respective elongate component is gripped and comprising a fixed part and a rotary part having at least one gripping member for gripping the elongate component, the rotary part being arranged to continuously rotate around 360 degrees in relation to the fixed part in order to continuously rotate the gripped elongate component around 360 degrees, wherein the rotary part comprises:

an actuator for acting upon the gripping member in order to grip or release the elongate component, and a power source operatively connected to the actuator;

energizing the actuator by the power source to cause the actuator to act upon the gripping member irrespective of whether the rotary part is rotating or at rest; and controlling the actuator and the power source by means of a wireless control mechanism located spaced from the rotary part of the at least one rotational tong unit and which is adapted to control the actuator and the power source irrespective of whether the rotary part is rotating or not, and wherein controlling the power source and the actuator includes wirelessly controlling the power source and the actuator.

35. A method as claimed in claim 34, wherein the power source, the actuator and the control mechanism of the at least one rotational tong unit form part of an auxiliary system for gripping or releasing the elongate component and for controlling the gripping force exerted by the actuator on the elongate component when the rotary part is rotating and the at least one rotational tong unit comprises a main system for gripping or releasing the elongate component; wherein the method further comprises:

using the auxiliary system as a top up system to increase the force exerted by the gripping member on the elongate component depending on the torque exerted on the elongate component as the rotary part rotates.

* * * * *